US009447788B2

(12) United States Patent
Henry et al.

(10) Patent No.: US 9,447,788 B2
(45) Date of Patent: Sep. 20, 2016

(54) LINEAR PUMP AND MOTOR SYSTEMS AND METHODS

(71) Applicants: James C. Henry, Midland, TX (US); James David Henry, Midland, TX (US); Ronald David Wallin, Midland, TX (US); Frederick Eugene Morrow, Midland, TX (US); Trevor Hardway, Midland, TX (US)

(72) Inventors: James C. Henry, Midland, TX (US); James David Henry, Midland, TX (US); Ronald David Wallin, Midland, TX (US); Frederick Eugene Morrow, Midland, TX (US); Trevor Hardway, Midland, TX (US)

(73) Assignee: HENRY RESEARCH AND DEVELOPMENT LLC, Midland, TX (US)

( * ) Notice: Subject to any disclaimer, the term of this patent is extended or adjusted under 35 U.S.C. 154(b) by 262 days.

(21) Appl. No.: 14/044,099

(22) Filed: Oct. 2, 2013

(65) Prior Publication Data

US 2014/0105759 A1 Apr. 17, 2014

Related U.S. Application Data

(60) Provisional application No. 61/708,761, filed on Oct. 2, 2012.

(51) Int. Cl.

*F04B 47/06* (2006.01)
*F04D 13/06* (2006.01)

(Continued)

(52) U.S. Cl.

CPC ..... *F04D 13/062* (2013.01); *F04B 17/03* (2013.01); *F04B 47/00* (2013.01); *F04B 47/02* (2013.01); *F04B 47/06* (2013.01); *F04B 47/12* (2013.01); *F15B 2015/1495* (2013.01)

(58) Field of Classification Search

CPC ..... F04B 17/03; F04B 47/00; F04B 47/06; F04B 9/02; F15B 15/088; F15B 2015/1495; F04D 13/062

USPC ..... 92/136; 417/415, 414; 166/372

See application file for complete search history.

(56) References Cited

U.S. PATENT DOCUMENTS 3,379,137 A * 4/1968 Harder ..... F04B 47/00 417/445
4,693,534 A * 9/1987 Clark ..... H01R 13/533 439/275

(Continued)

FOREIGN PATENT DOCUMENTS

CN 201103384 Y * 8/2008

OTHER PUBLICATIONS

Author: Luis et al. Title: Electrical Submersible Pumps for Geothermal Applications Date published(yyyy): 2010 Date Accessed(mm/dd/yyyy): Aug. 25, 2015 Link: http://www.s1b.com/~/media/Files/technical_papers/2010/2010_esp_geothermal_applications.pdf.*

(Continued)

*Primary Examiner* — Devon Kramer
*Assistant Examiner* — Chirag Jariwala
(74) *Attorney, Agent, or Firm* — Winstead PC

(57) ABSTRACT

A linear pump and motor system includes a motor, rotary-to-linear mechanism, pressure compensation device (PCD), and gas mitigation assembly. The rotary-to-linear mechanism may translate rotation of a motor into linear motion to provide a pumping action. A PCD may minimize a pressure differential between lubrication fluids and external fluids. A gas mitigation assembly may provide a mechanism that mechanically opens a valve. In some embodiments, a PCD may be utilized separately from the linear pump. In some embodiments, a gas mitigation assembly may be utilized separately from the linear pump.

17 Claims, 13 Drawing Sheets

(51) Int. Cl.

| | |
|---|---|
| ***F04B 17/03*** | (2006.01) |
| ***F04B 47/12*** | (2006.01) |
| ***F04B 47/00*** | (2006.01) |
| ***F04B 47/02*** | (2006.01) |
| *F15B 15/14* | (2006.01) |

(56) References Cited

U.S. PATENT DOCUMENTS 4,867,242 A 9/1989 Hart
5,097,902 A * 3/1992 Clark ..... F04C 13/008 166/106
6,155,792 A * 12/2000 Hartley ..... F04B 47/06 165/119
6,201,327 B1 * 3/2001 Rivas ..... F04D 13/062 310/87
6,929,064 B1 * 8/2005 Susman ..... F04C 2/3447 166/105
8,066,496 B2 * 11/2011 Brown ..... E21B 43/127 166/105
8,328,539 B2 * 12/2012 Watson ..... E21B 43/128 166/105.3
2010/0316504 A1 * 12/2010 Lack ..... E21B 43/126 417/53

OTHER PUBLICATIONS

Dennis Denney, Reciprocating Submersible Pump Improves Oil Production, JPT, Jul. 2012, pp. 92-94.

* cited by examiner

LINEAR PUMP AND MOTOR SYSTEMS AND METHODS

RELATED APPLICATIONS

This application claims the benefit of U.S. Provisional Patent Application No. 61/708,761 to Henry et al., filed on Oct. 2, 2012, which is incorporated herein by reference.

STATEMENT REGARDING FEDERALLY SPONSORED RESEARCH

Not Applicable.

REFERENCE TO A SEQUENCE LISTING

Not Applicable.

FIELD OF THE INVENTION

This invention relates to linear pump and motor systems. More particularly, to a linear pump and motor systems that provides improved operation and reliability. Additionally, the invention relates to a pressure compensation device and a gas mitigation assembly.

BACKGROUND OF INVENTION

Several varieties of pumps are utilized to pump fluids, such as oil, water, and other fluids. For example, rod pumps, electrical submersible pumps (ESPs), and the like are utilized to pump fluids from wells or the like. Rod pumps may be operated by a pumping unit that is above ground that pivotally oscillates to provide pumping action. A rod oscillates up and down, and may cause ball check valves (e.g. a traveling and standing valve) to open and close during pumping. Rod pumps systems may encounter issues, such as rod stretch, gas lock, or the like. ESPs are centrifugal pumps that may be place into a well to pump fluids. Some ESPs may require a minimum flow rate or speed at which the pump must operated at to prevent overheating of the motor.

A pressure compensation device may minimize or eliminate a pressure differential between two fluids. A gas mitigation assembly may prevent the build up of gas. A linear pump and motor system may provide improved operation and reliability.

SUMMARY OF THE INVENTION

In one embodiment, a pressure compensation device (PCD) may provide a tubular and a piston positioned within the tubular. The piston may move within the tubular in response to a pressure differential between a first and second fluid. The first fluid may fill the tubular above the piston, and the second fluid may fill the tubular below the piston. In some embodiments, the PCD may be utilized with the linear pump discussed herein. In other embodiments, the PCD may be utilized in a pump, motor or the like. In yet another embodiments, the PCD may be utilized in any other suitable application.

In another implementation, gas mitigation assembly is integrated with a traveling valve. The traveling valve may be positioned below the standing valve. During the upstroke, traveling valve may mechanically open the standing valve to allow trapped gas to be released. In some embodiments, the gas mitigation assembly may be utilized in a pump, motor or the like. In yet another embodiments, the gas mitigation assembly may be utilized in any other suitable application.

In yet another embodiment, a linear pump and motor system includes a motor, rotary-to-linear mechanism, PCD, and gas mitigation assembly. The rotary-to-linear mechanism may translate rotation of a motor into linear motion to provide a reciprocating pumping action. A PCD may minimize a pressure differential between lubrication fluids and external fluids. A gas mitigation assembly may provide a mechanism that mechanically opens a valve.

The foregoing has outlined rather broadly various features of the present disclosure in order that the detailed description that follows may be better understood. Additional features and advantages of the disclosure will be described hereinafter.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 1A:
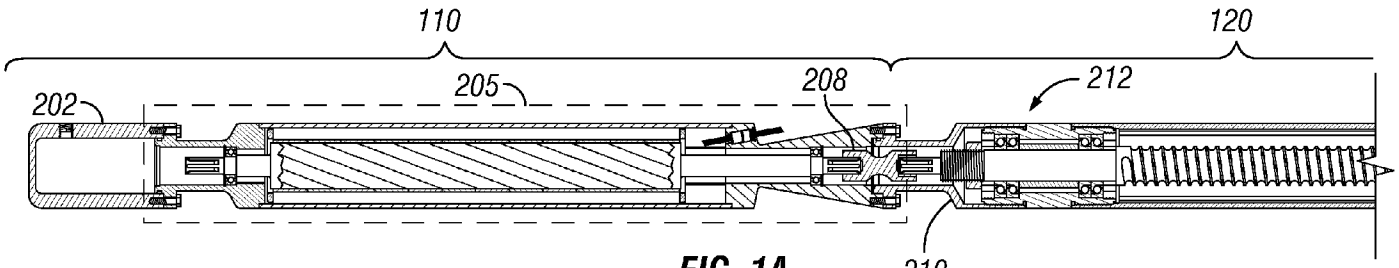
FIGS. 1A-1E are illustrative embodiments of a linear pump.

Refer now to the drawings wherein depicted elements are not necessarily shown to scale and wherein like or similar elements are designated by the same reference numeral through the several views.

Referring to the drawings in general, it will be understood that the illustrations are for the purpose of describing particular implementations of the disclosure and are not intended to be limiting thereto. While most of the terms used herein will be recognizable to those of ordinary skill in the art, it should be understood that when not explicitly defined, terms should be interpreted as adopting a meaning presently accepted by those of ordinary skill in the art.

It is to be understood that both the foregoing general description and the following detailed description are exemplary and explanatory only, and are not restrictive of the invention, as claimed. In this application, the use of the singular includes the plural, the word "a" or "an" means "at least one", and the use of "or" means "and/or", unless specifically stated otherwise. Furthermore, the use of the term "including", as well as other forms, such as "includes" and "included", is not limiting. Also, terms such as "element" or "component" encompass both elements or components comprising one unit and elements or components that comprise more than one unit unless specifically stated otherwise.

FIGS. 1A-1E are illustrative embodiments of a linear pump 100. The pump may provide a motor assembly 110, a ball screw/nut assembly 120, a pressure compensation device assembly 130, and gas mitigation assembly 140. FIGS. 2A-2D and 3A-3C are illustrative embodiments of a linear pump in a first and second position respectively. In the first position, the linear pump 100 has reached or is near the extended position of the extension pump stroke. A ball nut 220 is near the top of a ball screw 218 and traveling valve 255 is near standing valve 258 in the first position. In the second position, linear pump 100 has retracted or is near the retracted position of the retraction pump stroke. A ball nut 220 is near the bottom of a ball screw 218 and traveling valve 255 is separated from the standing valve 258 in the second position.

Figure 1B:
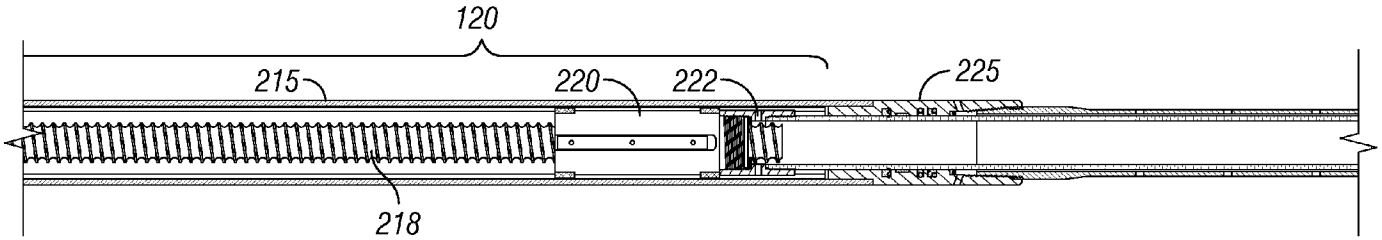
Figure 1C:
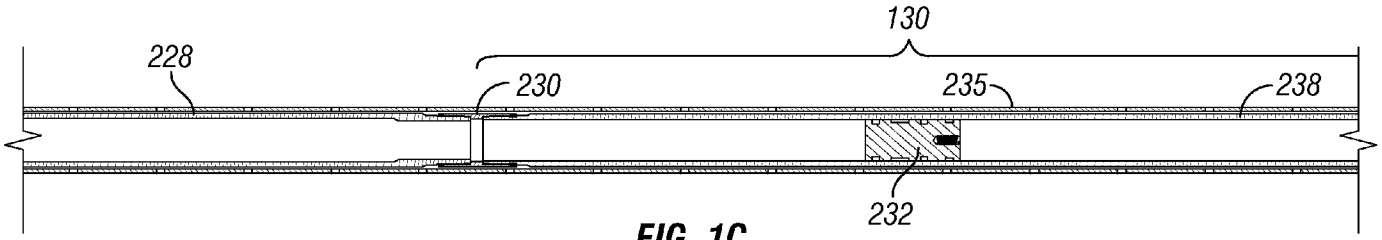
Figure 1D:
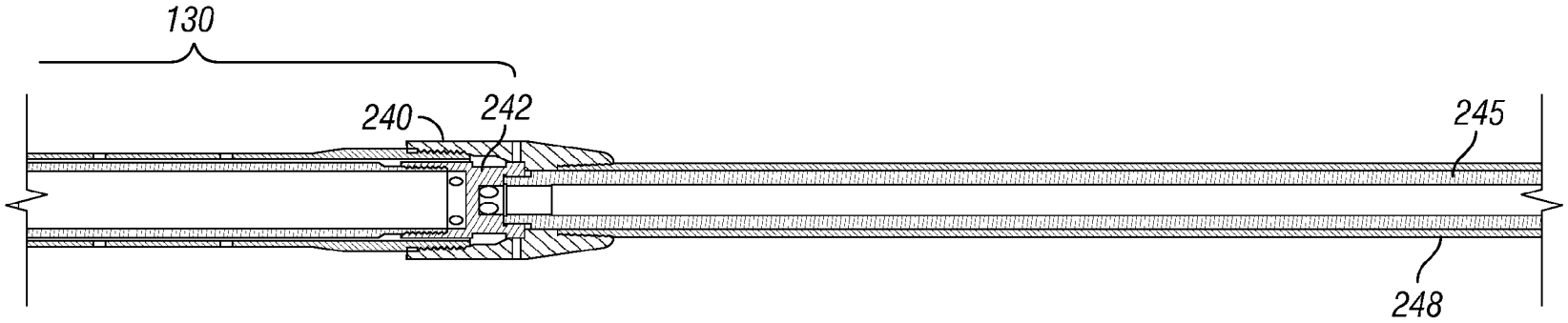
Figure 1E:
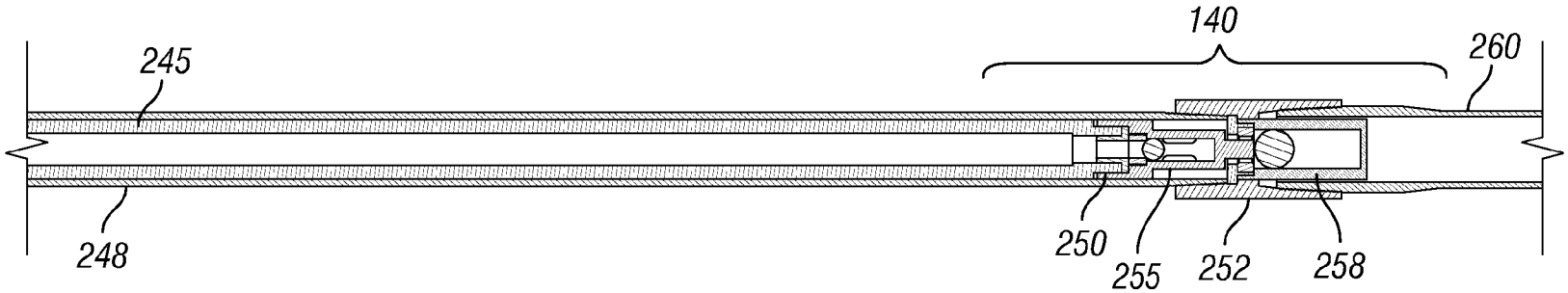
Figure 4A:
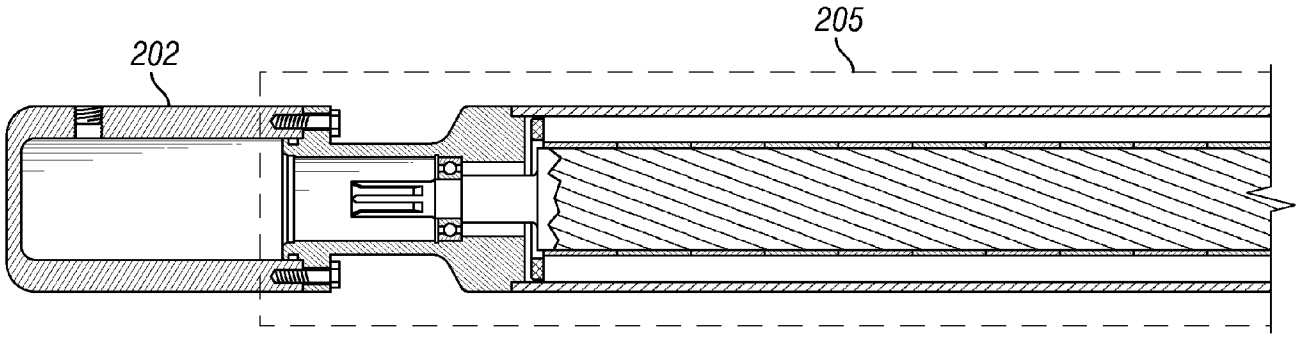
FIGS. 4A-4G are close up views of several components of a linear pump.
Figure 4B:
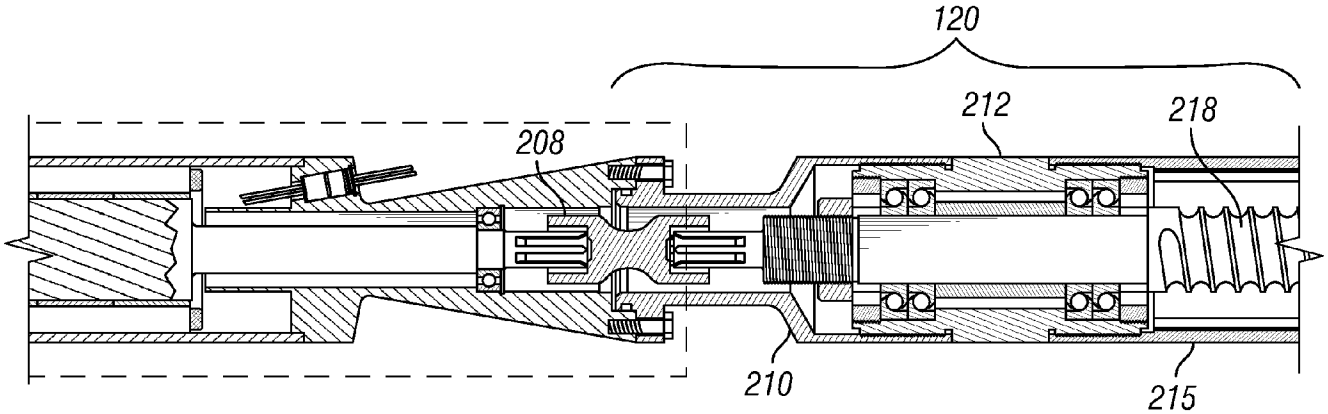
Figure 4C:
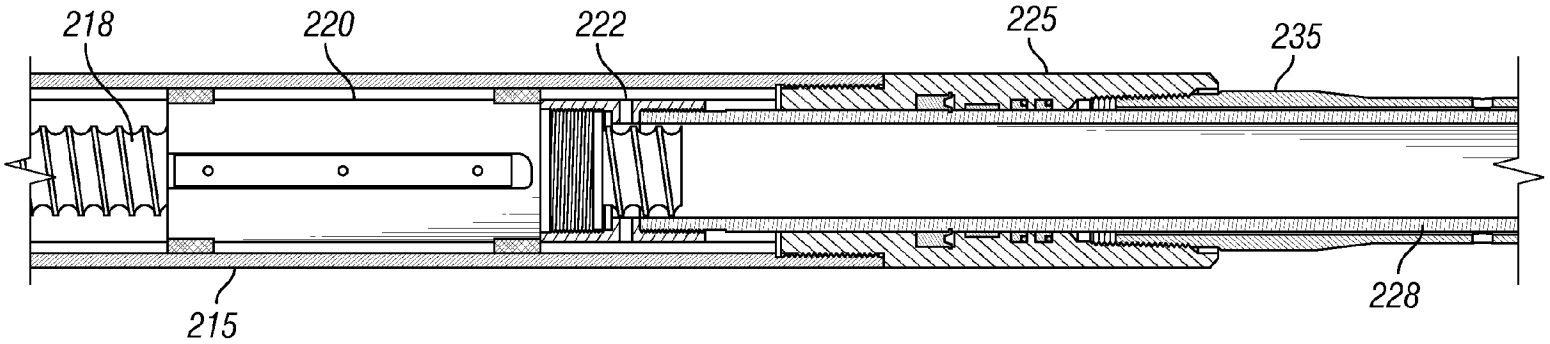
Figure 4D:
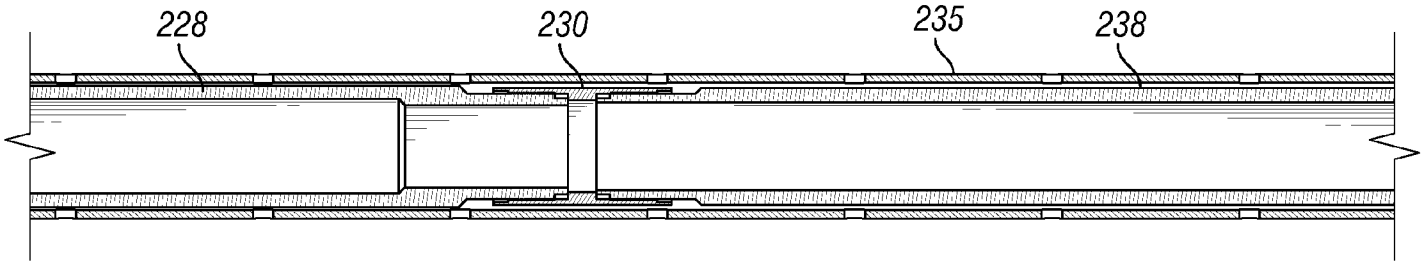
Figure 4E:
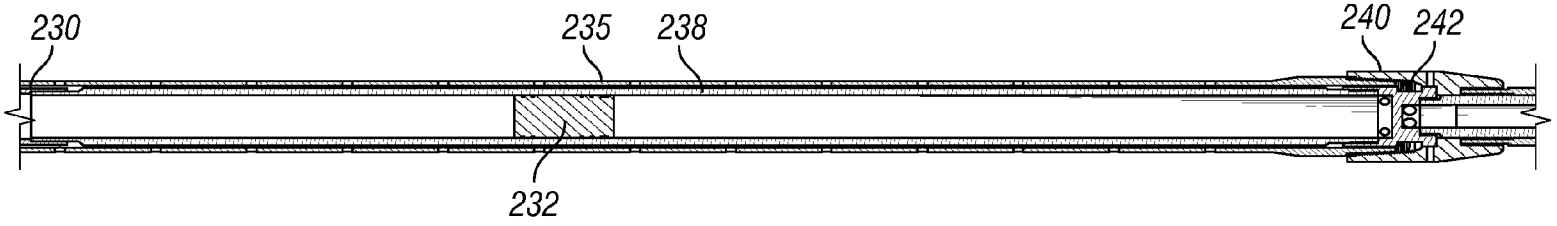
Figure 4F:
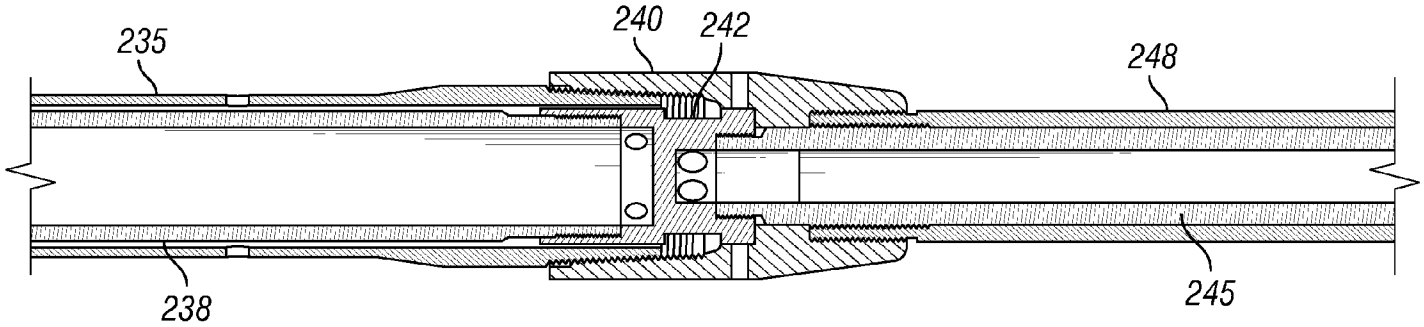
Figure 4G:
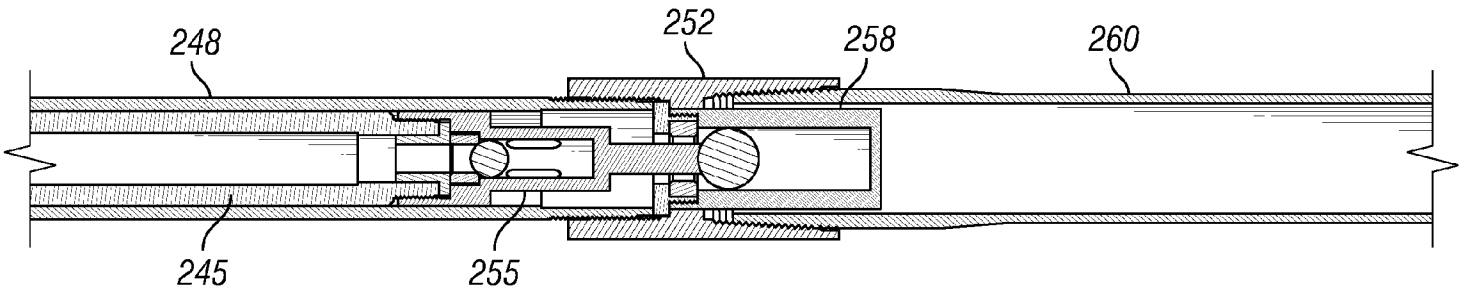
Figure 5B:
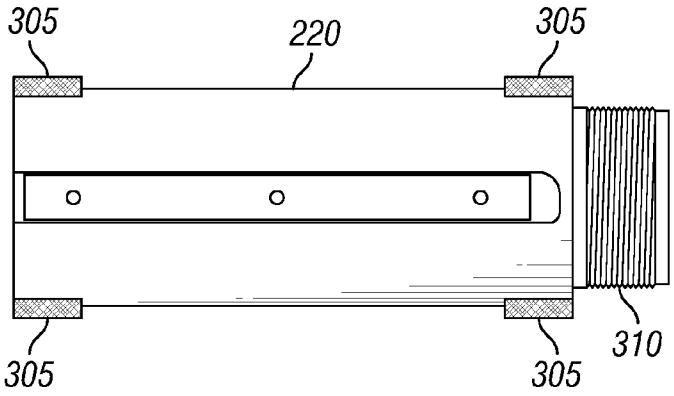
FIGS. 5A-5B are illustrative embodiments of a ball nut.
Figure 5A:
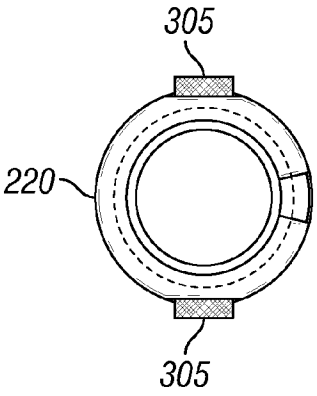
Figure 6B:
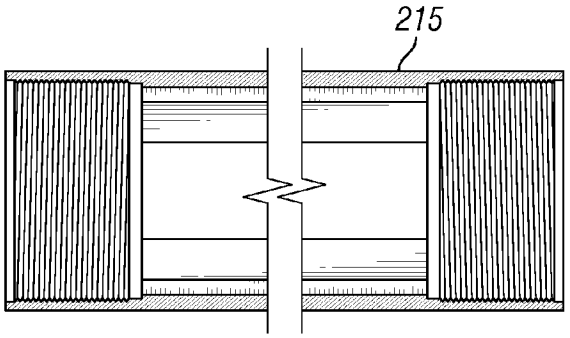
FIGS. 6A-6B are illustrative embodiments of a ball screw guide.
Figure 6A:
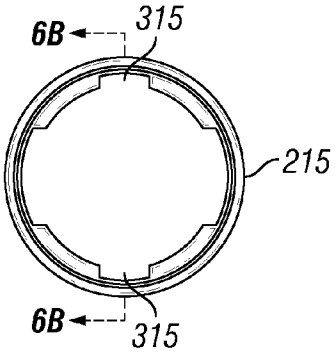

FIGS. 4A-4G are close up views of several components of a linear pump 100. A motor cap 202 may be coupled to a first end of a motor 205. The motor cap 202 may seal and provided a reservoir for oil for the motor 205. The motor 205 may be any suitable motor, such as a DC motor, AC motor, permanent magnet motor, or hydraulic motor, that is coupled to a ball screw/nut assembly 120. In some embodiments, a coupling 208 may be utilized to couple the motor shaft to the ball screw. Ball screw/nut assembly 120 is a rotary-to-linear mechanism that translates rotary motion into linear motion. The ball screw/nut assembly 120 translates rotary motion from the motor into linear motion. In some embodiments, an adapter 210 may couple the motor to a thrust bearing assembly 212. Thrust bearing assembly 212 may provide one or more thrust bearings for the ball screw 218. The ball screw/nut assembly 120 may also be lubricated with oil, such as a mineral oil or any suitable lubricating oil. In some embodiments, a gearing system is not necessary. In other embodiments, a gearing system (not shown) may be utilized to couple the motor 205 to the ball screw 218 so that changes in speed, torque, direction, or a combination thereof can be provided. The outer surface of the ball screw 218 may be threaded or the like. FIGS. 5A-5B are illustrative embodiments of a ball nut. The ball nut 220 may have inner diameter surface that is also threaded or the like to allow the ball nut 220 to be threadably coupled to the ball screw 218 as shown in FIG. 1B. The outer diameter of the ball nut 220 may also provide one or more guides 305. One end of the ball nut 220 may provide threads or the like 310 that may be utilized couple the ball nut 220 to another component, such as a coupling nut 222 (FIGS. 7A-7B) or ball screw encapsulator 228 (FIG. 1C). The ball screw 218 and ball nut 220 are positioned within a ball screw guide 215 as shown in FIG. 1B. FIGS. 6A-6B are illustrative embodiments of a ball screw guide. The inside diameter of ball screw guide 215 may provide one or more slots 315 that are suitable for receiving the guides 305 (FIGS. 5A-5B) of the ball nut 220 to prevent the ball nut from rotating. In other embodiments, ball screw/nut assembly 120 may be substituted with another mechanism for translating rotary motion into linear motion or a rotary-to-linear mechanism. Various rotary-to-linear mechanisms that translate rotary motion to linear motion may be suitable. For example, rotary-to-linear mechanisms utilizing rack and pinions, worm gears, ball screws, roller screws, cranks, or the like may be utilized. In an illustrative embodiment, the rotary-to-linear mechanism may be a roller screw assembly or ball screw assembly. A roller screw assembly may provide two or more rollers positioned between a screw and nut. The rollers may be cylindrically shaped rods that are threaded to allow the threads to mate with threads provided by the screw and nut. A ball screw assembly also provides a screw and a nut, and utilizes ball bearings positioned between the threads or grooves of the screw and nut. Any suitable roller screw assembly or ball screw assembly may be utilized. For example, U.S. Pat. No. 3,884,090 and U.S. Pat. No. 5,228,353 provide nonlimiting examples of a roller screw assembly and a ball screw assembly.

Figure 7B:
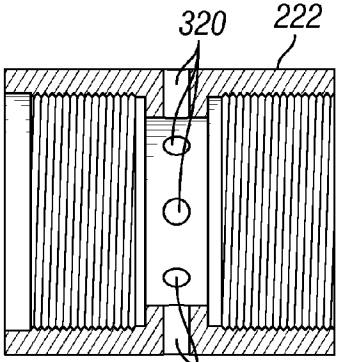
FIGS. 7A-7B are illustrative embodiments of a coupling nut.
Figure 7A:
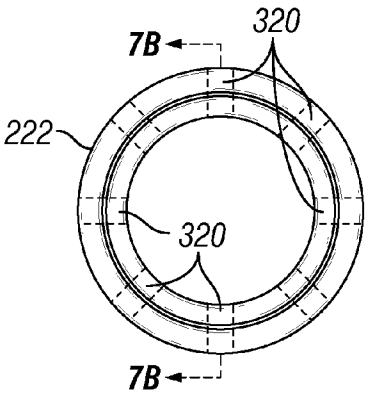

When the ball screw 218 is rotated in a first direction, the thread coupling causes ball nut 220 to moves linearly in a first direction. When the ball screw 218 is rotated in an opposite direction, the thread coupling causes ball nut 220 to move in an opposite direction. For example, rotation of the ball screw 218 clockwise may cause the ball nut 220 to move down towards the motor 205, and rotation of the ball screw 218 counterclockwise may cause the ball nut 220 to move away from the motor 205. During operation of the linear pump 100, the motor 205 is repeatedly rotated back and forth in a clockwise and counterclockwise direction, thereby causing the ball nut 220 to move up and down along a linear path. The reciprocating movement of the ball nut 220 is utilized to provide the pumping action for the linear pump. The stroke length of the linear pump can be precisely control. Further, the stroke length is defined and repeatable, whereas other systems such as rod pumps may experience rod or tubing stretch with each stroke making the stroke length unpredictable. The ball nut 220 may be coupled to a ball screw encapsulator 228. For example, a coupling nut 222 may be provided that allows the ball nut 220 to be coupled to the ball screw encapsulator 228 using threads or the like. FIGS. 7A-7B are illustrative embodiments of a coupling nut. In some embodiments, the coupling nut 222 may be an oil transfer coupling nut, which may provide one or more openings 320 on the outer circumference. Openings 320 may provide a fluid passageway for oil to transfer between the ball screw guide 215 and a pressure compensation device (PCD).

Ball screw encapsulator 228 may be sealed on it outer diameter by a seal coupling 225. For example, seal coupling 225 may provide one or more seals on its inner diameter. A first end of the seal coupling 225 may be coupled to the ball screw guide 215, and a second end of the seal coupling may be coupled a tubular 235, such as a perforated sub. A coupling 230 may connect ball screw encapsulator 228 to a PCD tubular housing 238, which causes the PCD tubular housing 238 to move when the ball nut 220 is moved. As the ball nut 220 moves linearly, the ball screw encapsulator 228 and the PCD tubular housing 238 move within the ball screw guide 215 and tubular 235. While the perforated sub allows formation fluids to enter, the outside diameter of ball screw encapsulator 228 is in contact with the seals retained within seal couplings 225, which prevents oil for the ball screw assembly and motor 205 from mixing with the formation fluids entering the perforated sub.

Figure 2A:
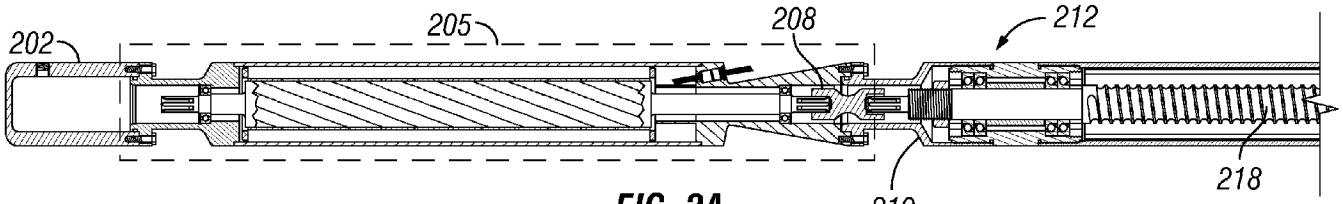
FIGS. 2A-2D are illustrative embodiments of a linear pump in a first position.
Figure 2B:
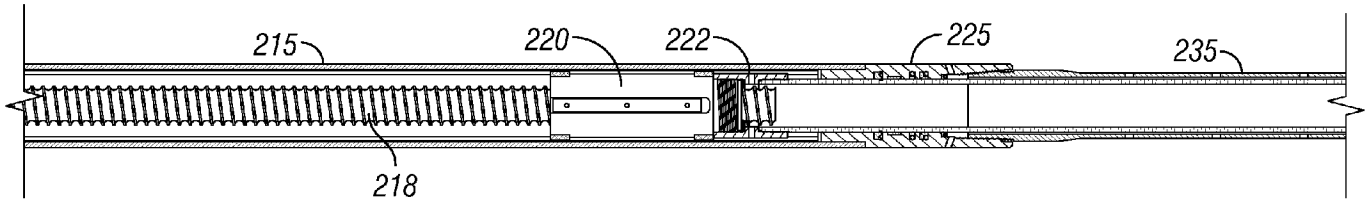
Figure 2C:
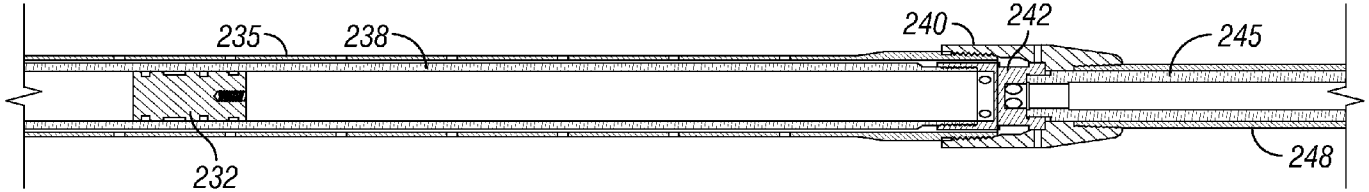
Figure 3A:
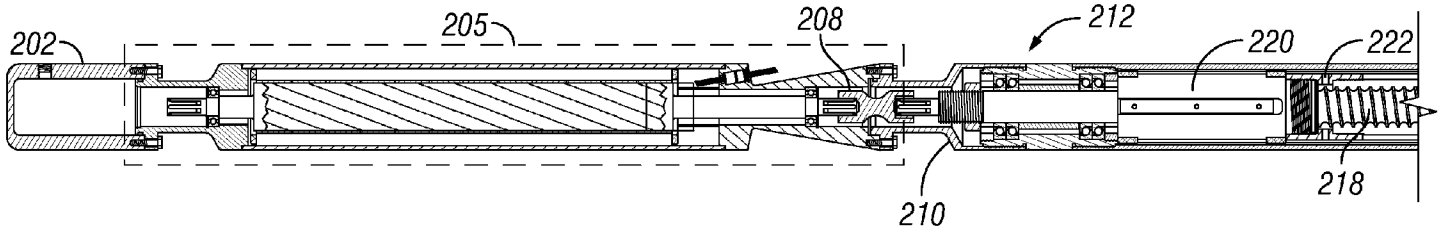
FIGS. 3A-3C are illustrative embodiments of a linear pump in a second position.
Figure 3B:
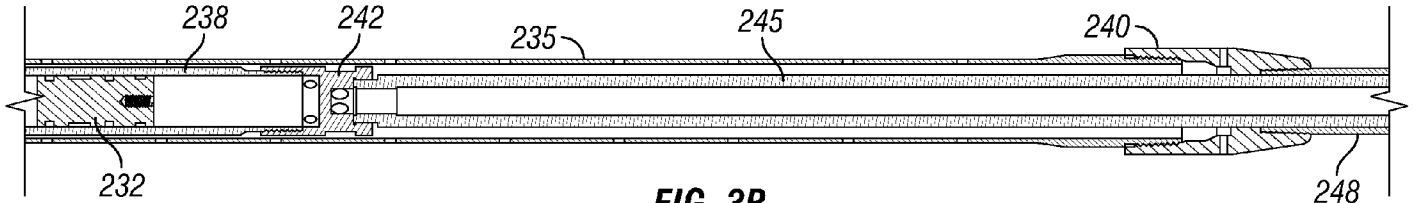
Figure 8B:
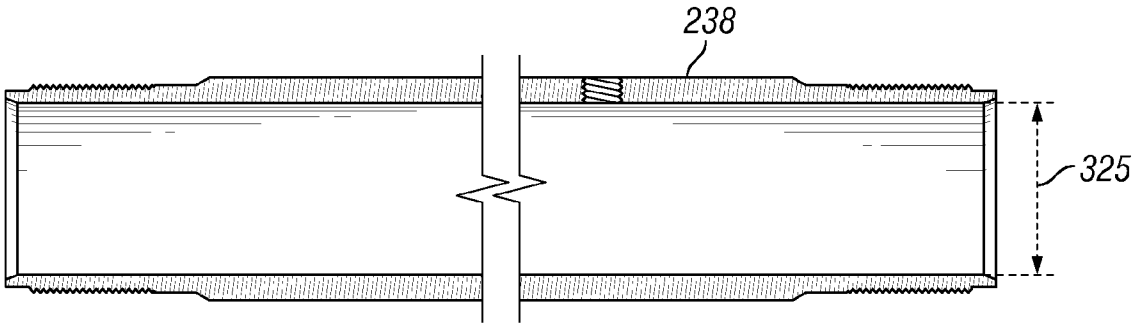
FIGS. 8A-8D are illustrative embodiments of a tubular and shuttle piston.
Figure 8D:
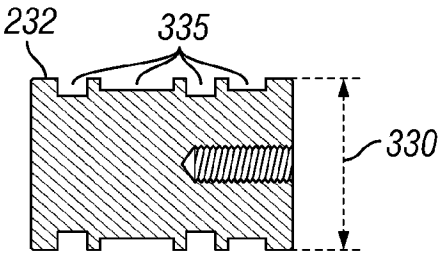
Figure 8A:
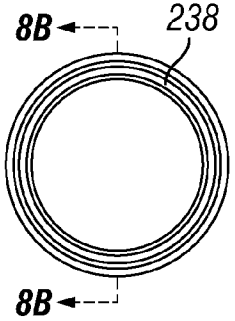
Figure 8C:
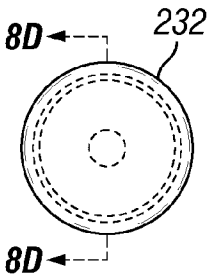

Further, the pressure compensation device (PCD) provides a PCD tubular housing 238 and a shuttle piston 232 that also prevents lubricating oil for the ball screw assembly and motor 205 from mixing with formation fluids. FIGS. 8A-8B are illustrative embodiments of PCD tubular housing 238, and FIGS. 8C-8D are illustrative embodiments of a shuttle piston 232. The shuttle piston 232 is disposed within the PCD tubular housing 238. The internal diameter 325 of PCD tubular housing 238 is slightly larger than the outer diameter 330 of the shuttle piston 232 so that the shuttle piston may fit within the PCD tubular housing 238. Further, shuttle piston 232 minimizes or prevents lubrication oil from mixing with formation fluids. The shuttle piston 232 may move within the PCD tubular housing 238 in accordance with a pressure differential between fluids above and below the shuttle piston 232. For example, as shown in FIGS. 2B and 3B, the position of the shuttle piston 232 within PCD tubular housing 238 may vary during the upstroke and downstroke. As ball nut 220 moves towards and away from the motor, oil may enter and exit the inner diameter of the ball screw encapsulator 228 and the PCD tubular housing 238 of the PCD. Further, the formation fluids above the shuttle piston 232 may enter or exit the inner diameter of the PCD tubular housing 238 of the PCD. The shuttle piston 232 may move within the tubular to balance or minimize the pressure differential between the oil and the formation fluids. As an example, when the formation fluids pressure is higher than the lubricating oil pressure, the shuttle piston 232 may move towards the motor 205. When the lubricating oil pressure is higher than the pressure of the formation fluids, the shuttle piston 232 may move away from the motor 205. In some embodiments, the shuttle piston 232 may move in response to any pressure differential. For example, in some embodiments, the pressure differential necessary to move the shuttle piston may be 1500 psi or less. In other embodiments, the pressure differential necessary to move the shuttle piston may be 1000 psi or less. In other embodiments, the pressure differential necessary to move the shuttle piston may be 500 psi or less. In some embodiments, the pressure differential necessary to move the shuttle piston may be 200 psi or less. In other embodiments, the pressure differential necessary to move the shuttle piston may be 150 psi or less. In other embodiments, the pressure differential necessary to move the shuttle piston may be 100 psi or less. In other embodiments, the pressure differential necessary to move the shuttle piston may be 50 psi or less. In other embodiments, the pressure differential necessary to move the shuttle piston may be 10 psi or less. As the oil pressure changes with the displacement of lubricating oil caused by the movement of the ball screw encapsulator 228, it is apparent that the amount of displaced oil caused by the ball screw encapsulator 228 influences the movement of shuttle piston 232. Additionally, thermal expansion may also be partially responsible for movement of the shuttle piston 232. Shuttle piston 232 may move within PCD tubular housing 238 to provide pressure compensation in the pump. In some embodiments, shuttle piston 232 may move the complete length of PCD tubular housing 238 or less during a pump stroke. In some embodiment, shuttle piston 232 may move 150 inches or less during a pump stroke. In some embodiment, shuttle piston 232 may move 100 inches or less during a pump stroke. In some embodiment, shuttle piston 232 may move 50 inches or less during a pump stroke. For example, in the embodiment shown, the shuttle piston 232 may move approximately 27 inches or less. In some embodiments, mixing of oil for the ball screw assembly and the formation fluids may be undesirable. Consequently, in some embodiments, groove/opening 335 for receiving seals may be place on the shuttle piston to prevent or minimize fluid leakage between the shuttle piston and the tubular. The seals may be any suitable seals. Further, in some embodiments, additional grooves may be provided for scraper rings to removed deposits from PCD tubular housing 238 or a guide ring that keeps the shuttle piston centered in the PCD tubular. By balancing or nearly balancing the pressure between the oil and formation fluids, the PCD minimizes or prevents a pressure differential that may cause oil or fluids to be forced out or sucked through seal coupling 225, coupling 230, shuttle piston 232, or any other areas of the linear pump 100. As such, the PCD minimizes or prevents the loss of lubricating oil, prevents mixing of external fluids with the lubricating oil, or both.

Figure 9A:
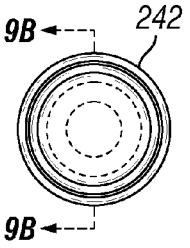
FIGS. 9A-9B are illustrative embodiments of an intake coupling nut.
Figure 9B:
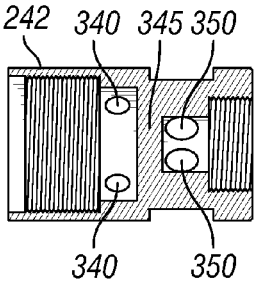

The tubular 235 may be perforated to allow formation fluids to enter into the pump 100. The tubular 238 of the PCD device may be coupled to an intake coupling nut 242, and the intake coupling nut 242 is also coupled to a pump plunger 245. FIGS. 9A-9B are illustrative embodiments of an intake coupling nut 242. Intake coupling nut 242 allows formation fluids that have entered the perforated sub to enter into the PCD tubular housing 238 of the PCD through one or more openings 340. Opening 340 are separated from one or more additional openings 350 by a central portion 345 of the intake coupling nut 242. Additional openings 350 in the intake coupling nut 242 allow formation fluids to enter the inner diameter of the pump plunger 245. While the chambers of the PCD tubular housing 238 of the PCD and the pump plunger 245 are separated by central portion 345, fluid communication is provided since the perforated tubular 235 does not isolate openings 340 from the additional openings 350. As such, fluid pressure from fluids in pump plunger 245 are translated to fluids in the PCD tubular housing 238 of PCD and vice versa. Since the intake coupling nut 242 secures the pump plunger 245 to the PCD tubular housing 238 of the PCD, the pump plunger 245 also moves up and down with the ball nut 220. The perforated tubular 235 is coupled to a pump barrel 248 with a coupling 240. As such, perforated tubular 235, pump barrel 248, seal coupling 225, and ball screw guide 215 remain stationary relative to ball nut 220. In some embodiments, it may be desirable for coupling 240 to provide openings. The openings in coupling 240 may be provided to vent fluid or debris, to prevent hydraulic locking, to allows fluid trapped on intake coupling 242 to vent and not be compressed, or the like (FIG. 4F).

Figure 10A:
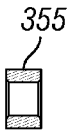
FIGS. 10A-10C are illustrative embodiments of an exploded view of a traveling valve assembly.
Figure 10B:
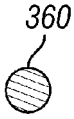
Figure 10C:
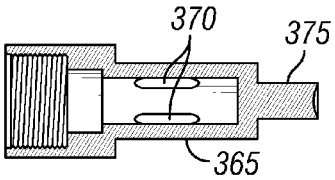
Figure 11A:
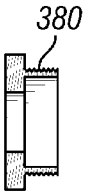
FIGS. 11A-11D are illustrative embodiments of an exploded view of a standing valve assembly.
Figure 11B:
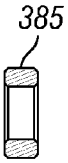
Figure 11C:
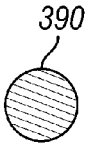
Figure 11D:
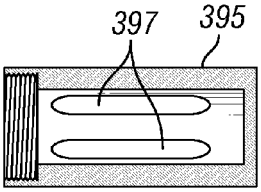

As the ball nut 220 is moved by the motor 205, pump plunger 245 moves up and down within the pump barrel 248 to pump formation fluids. As discuss previously, unlike rod pumps that experience rod or tubing stretch during each pump stroke, the linear pump provides for repeatable and precise control of a stroke length and position. In some embodiments, the linear pump discussed herein allows the stroke length and position to be precisely controlled within 49 mm or less. In some embodiments, the linear pump discussed herein allows the stroke length and position to be precisely controlled within 40 mm or less. In some embodiments, the linear pump discussed herein allows the stroke length and position to be precisely controlled within 30 mm or less. In some embodiments, the linear pump discussed herein allows the stroke length and position to be precisely controlled within 20 mm or less. In some embodiments, the linear pump discussed herein allows the stroke length and position to be precisely controlled within 10 mm or less. In some embodiments, the linear pump discussed herein allows the stroke length and position to be precisely controlled within 12.7 mm or less. Further, the ability to accurately control the stroke length and position does not degrade over time. This precise and repeatable control allows the position of the pump plunger 245 relative to the pump barrel 248 to be easily determined at all times. The pump barrel 248 is coupled to producing tubing 260 with a coupling 252. A top portion of the pump plunger 245 is coupled to a thrust insert 250 and traveling valve assembly 255. FIGS. 10A-10C are illustrative embodiments of an exploded view of a traveling valve assembly. Traveling valve assembly 255 provides a cage 365, ball 360, and seat 355. The ball 360 fits within the inner diameter of the cage 365, which provides one or more slots 370. The seat 355 has an inner diameter smaller than the diameter of the ball 360 to secure the ball within the cage of the traveling valve assembly 255. The traveling valve assembly 255 may operate in accordance with a pressure differential, which may cause movement of the ball 360 within the cage 365 to expose the slots 370 in the cage. For example, when the ball 360 is positioned on the seat 355, the slots 370 are not exposed and fluids cannot flow past of the traveling valve seat 355. When the fluid pressure in the pump plunger 245 is sufficient to move the ball 360 away from the seat 355 to expose the slots 370, fluid may flow out of the traveling valve assembly 255. In some embodiments, travelling valve assembly 255 may provide an optional probe or tip 375 on the cage 365 that may be utilized to unseat the ball of a standing valve, which is discussed in further detail below.

Figure 3C:
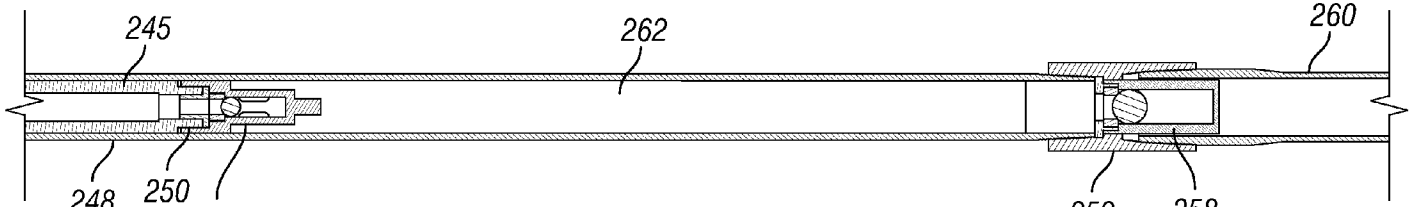

As an illustration, an example describing operation of the traveling valve assembly 255 is provided. When the pump plunger 245 and traveling valve assembly 255 are retracted towards the motor and away from a standing valve assembly 258 (downstroke), the inner diameter of the pump plunger 245 may be filled with formation fluids entering through intake coupling nut 242. Further, during the downstroke, ball 360 may be moved to allow fluids to flow out of pump plunger 245 through the traveling valve assembly 255. As shown in FIG. 3C, the downstroke increase the volume of a region 262 of pump barrel 248 between the traveling valve assembly 255 and standing valve assembly 258. When ball 360 is moved during the downstroke, region 262 may be filled with formation fluids.

Next, the pump plunger 245 and traveling valve assembly 255 are extended away from the motor 205 or back towards the standing valve (upstroke). During the upstroke, ball 360 of the traveling valve assembly 255 may become seated on seat 355 to prevent the flow of formation fluids into the pump plunger 245. As a result, fluid pressure of formation fluids between the traveling valve assembly 255 and standing valve assembly 258 may increase since the fluid is being compressed by pump plunger 245.

FIGS. 11A-11D are illustrative embodiments of an exploded view of a standing valve assembly 258. In some embodiments, the standing valve may provide a cage 395, ball 390, seat 385, and seat nut 380. The seat nut 380 may secure the ball 390 and seat 385 within the cage 395. In some embodiments, seat nut 380 and seat 385 may be combined into a single piece. As with the standing valve assembly 258, the position of ball 390 within cage 395 determines whether one or more slots 397 are exposed to allow fluid flow. For example, during the downstroke, the ball 390 is positioned on the seat 385 to prevent the flow of fluid in production tubing 260 into pump barrel 248. Further, pump barrel 248 is being filled with formation fluids during the downstroke. During the upstroke, the formation fluids within the pump barrel 248 between the traveling and standing valves is compressed causing the ball 390 in the standing valve assembly 258 rise upward to expose the one or more slots 397 in the cage 395 of the standing valve assembly 258. The exposure of the slots 397 in the cage 395 allows the formation fluids in the pump barrel 248 to flow into the production tubing 260.

Figure 2D:
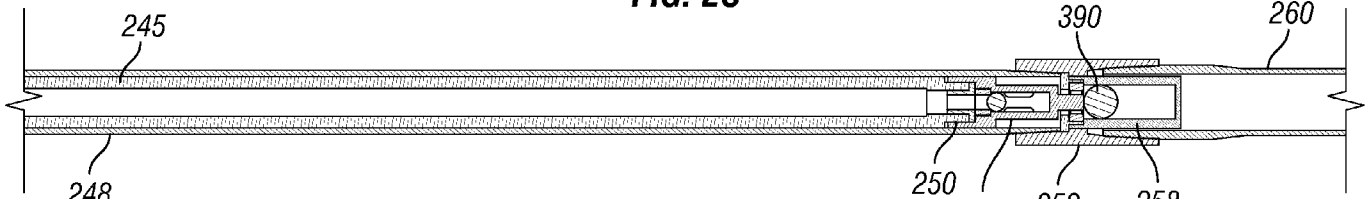

The traveling valve assembly 255 and standing valve assembly 258 may also provide gas mitigation features. During pumping, gas may be released from formation fluids or enter into the pump. The gas may enter the pump barrel 248 between the standing 258 and traveling valve 255 assembly. As gases can be compressed more than liquids, the presence of gas may cause gas lock. For example, if enough gas is present between the traveling valve assembly 255 and standing valve assembly 258, the pressure exerted by gas compressed on the upstroke may not be sufficient to move ball 390 in the standing valve assembly 258. In order to prevent gas lock, the cage 365 of the traveling valve assembly 255 may provide a probe 375. As shown in FIG. 2D, in the extended position of the pump stroke, probe 375 may contact ball 390 to cause it to be mechanically open. The length of probe 375 is sufficient to move ball 390, but is not long enough to cause ball 390 contact the top of cage 395. In some embodiments, one or more stops may be provided to prevent the probe 375 and/or traveling valve cage 365 from damaging the standing valve assembly 258 by overstroking past a desired stopping point in the extension stroke. For example, coupling nut 222 may contact a shoulder of seal coupling 225, intake coupling nut 242 may contact a shoulder of coupling 240, a top portion of traveling valve cage 365 may contact the bottom portion of standing valve assembly 258, or combinations thereof to act as a stop to prevent overstroking. As the downstroke begins, probe 375 may disengage from ball 390 and the formation fluids in the production tubing 260 may cause the ball 390 of the standing valve assembly 258 to return to the seat 385 to prevent the flow fluids from the production tubing 260 to pump barrel 248. It will be recognized that the embodiments discussed are provided for illustrative purposes only. Further, various features of the linear pump 100 may be modified, simplified, rearranged, or the like.

It will be recognized that several components of the linear pump 100 may be adapted for other applications. The following provides a discussion of non-limiting examples of alternative uses for certain components of the linear pump 100.

Pressure Compensation Device (PCD)

While the Pressure Compensation Device (PCD) is utilized in the linear pump discussed above, it will be recognized by one of ordinary skill in the art that the PCD may be suitable for use in several other applications. The PCD may be utilized in any device in which it is desirable to balance pressures between two fluids that are undesirable to mix.

Figure 12A:
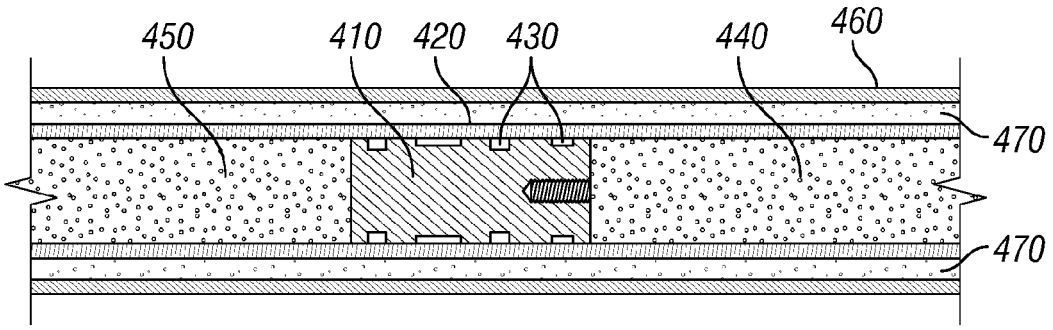
FIGS. 12A-12C are illustrative embodiments of a PCD.
Figure 12B:
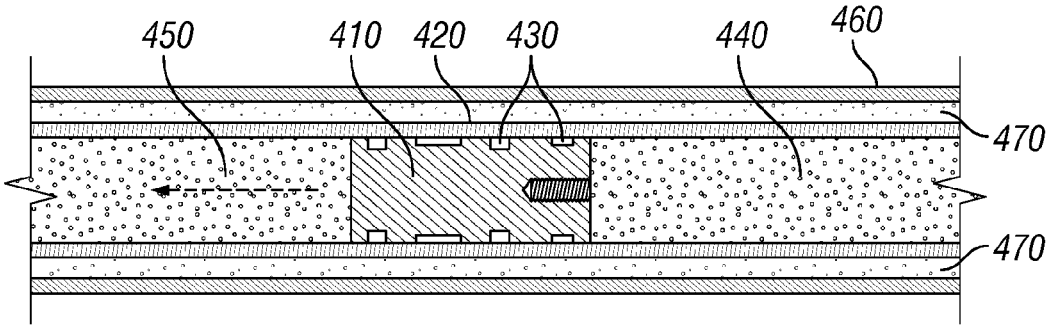
Figure 12C:
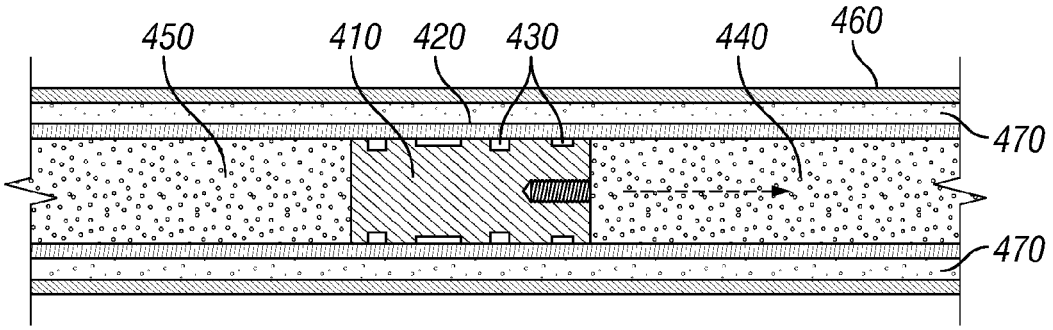

FIGS. 12A-12C are illustrative embodiments of a PCD. The PCD 400 may comprise a shuttle piston 410 and a tubular housing 420. Shuttle piston 410 may provide one or more grooves 430 for shuttle piston seals or the like. In a first region 440 above shuttle piston 410 a first fluid may be provided. In a second region 450 below shuttle piston 410 a second fluid may be provided. The first and second fluid may be oil, water, formation fluids, or any other fluid.

Tubular housing 420 may be position in a well, borehole, casing, formation or the like. For purposes of illustration, tubular housing 420 is shown in a casing 460 for a well. A third region 470 between the casing 460 and tubular housing 420 may be filled with the same fluid that is provided in the first region 440 (embodiment shown) or the same fluid that is provided in the second region 450 (reversed embodiment—not shown). For purposes of illustration, the first fluid is also provided in the third region 470, and the first region 440 may be in fluid communication with the third region 470. As a result, the fluid pressure outside of tubular housing 420 in the third region may be approximately the same as the fluid pressure in the first region above the tubular. It will be recognized that in the reversed embodiment, second region 450 may be in fluid communication with the third region 470.

The bottom of tubular housing 420 may be coupled to a motor, pump, or the like. The second fluid in the second region 450 may be isolated to prevent mixing with other fluids. For example, the second fluid may be a lubricating fluid for the motor, pump, or the like. Seals, threaded connections, or the like may be provided to isolate the second fluid from other fluids, such as the first fluid. However, the second fluid may become pressurized or de-pressurized during operation of the motor, pump, or the like due to displacement of second fluid, thermal expansion/shrinking, or the like. As a result, without pressure compensation, the second fluid may be forced out through connections, seals, or the like when pressure is high or external fluid may be sucked in through connections, seals, or the like when the pressure is low. The loss of the lubricating fluid or mixing of lubrication fluid and external fluids may cause damage to or reduce performance of the motor, pump, or the like.

In order to prevent such issues, a pressure compensation device may be provided to minimize or eliminate the pressure differential between the two fluids. As shown in FIG. 12B, when de-pressurization of the second fluid occurs (such as by displacing fluid; stopping operation of the motor, pump, or the like; thermal shrinking; or the like), shuttle piston 410 may move down. As shown in FIG. 12C, when pressurization of the second fluid occurs (such as by displacing fluid; operating of the motor, pump, or the like; thermal expansion; or the like), shuttle piston 410 may move up.

Gas Mitigation

Figure 13A:
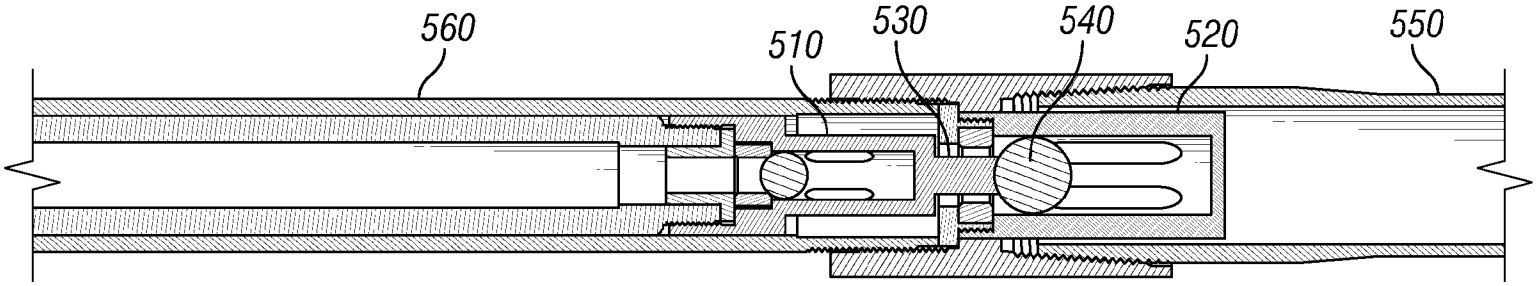
FIGS. 13A-13B are illustrative embodiments of a gas mitigation assembly.
Figure 13B:
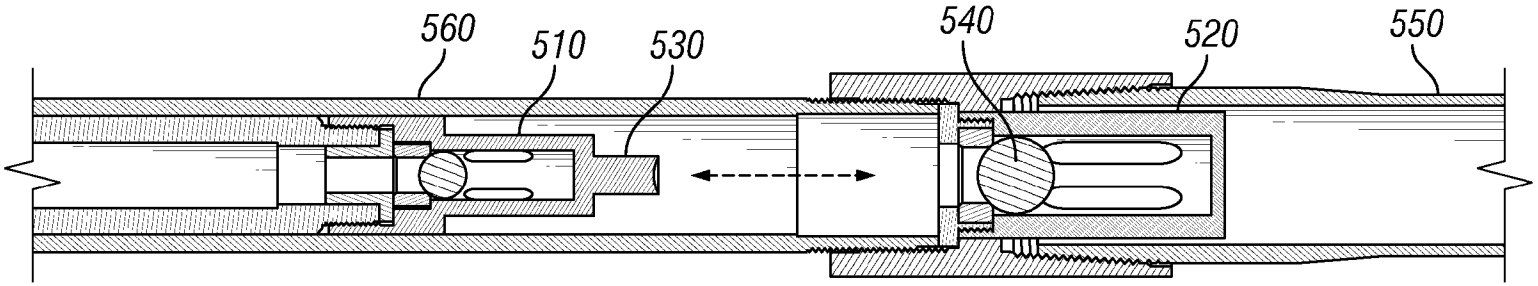

FIGS. 13A-13B are illustrative embodiments of a gas mitigation assembly 500. The gas mitigation assembly 500 may comprise a traveling valve assembly acting on a standing valve assembly. While the gas mitigation assembly (GMA) is utilized in the linear pump discussed above, it will be recognized by one of ordinary skill in the art that the GMA may be suitable for use in several other applications. The GMA may be utilized in any device in which it is desirable to prevent gas lock in a pump.

Prior systems provided the traveling valve above the standing valve. As such, the downward movement of the traveling valve in such system make it difficult to use the traveling valve to open or unseat the ball of the standing valve. In other words, the downward motion of the traveling valve would allow the standing valve ball to move into seat of the standing valve.

In contrast, the standing valve 520 and ball 540 are provided above the traveling valve 510 in production tubing 550. The standing valve 520 remains stationary, whereas the traveling valve 510 may extend and retract within the pump barrel. Since the traveling valve 510 moves linearly in relation to the standing valve 520, the traveling valve 510 may be coupled to a linear mechanism 560. For example, in the exemplary embodiment discussed previously, the traveling valve 510 was coupled to a ball screw/nut assembly. However, in other embodiments, traveling valve 510 may be coupled to a rod pump, rod screw assembly, or any other suitable linear mechanism utilized in pumps or motors. During pumping or the like, gas may be present between the standing 520 and traveling valve 510 that may cause gas lock. As a result of the linear motion provided by linear mechanism 560, probe 530 of the traveling valve 510 may mechanically open the standing valve 520.

Advantages

The linear pump and components discussed above provide several advantages over existing systems. Some ESP motors require significant amounts of production fluids to pass around the ESP motor to prevent overheating. As a result, low production wells are not suitable for continuous operation of ESP motors at low speeds. For example, some ESP motors are not suitable for operation at speeds below 60 Hz, 3600 rpm, or production rates of 300 barrels per day or less. To prevent overheating of ESPs in low production wells, the ESPs may be cycled on and off at normal speeds (e.g. 60 Hz) or greater to prevent overheating. In some embodiments, the linear pump discussed herein may operate in low production wells that provide 400 barrels per day or less. In some embodiments, the linear pump discussed herein may operate in low production wells that provide 300 barrels per day or less. In some embodiments, the linear pump discussed herein may operate in low production wells that provide 250 barrels per day or less. In some embodiments, the linear pump discussed herein may operate in low production wells that provide 200 barrels per day or less. In some embodiments, the linear pump discussed herein may operate in low production wells that provide 150 barrels per day or less. In some embodiments, the linear pump may operate in low production wells that provide 100 barrels per day or less. The linear pump is capable of operating in low production wells because it does not require a certain amount of production fluids to pass by the motor. In some embodiments, the linear pump may operate at 3000 rpm or less. In some embodiments, the linear pump may operate at 2500 rpm or less. In some embodiments, the linear pump may operate at 2000 rpm or less. In some embodiments, the linear pump may operate at 1500 rpm or less. Lubricating oil utilized by the motor is sealed off from production fluids and provides sufficient cooling and lubrication to prevent overheating. Rod Lift systems require significant horsepower to lift a rod string, have frictional losses between the sucker rod and tubing, and may have rod or tubing stretch with each stroke. The linear pump discussed provides several advantages over the alternatives, such as allowing the use of a more efficient, lower power motor, reducing frictional losses due to elimination of the rod string, etc. Further, the linear pump discussed has a defined and repeatable stroke. In other words, a length that the ball nut can travel up or down along the ball screw will not change over time. Additionally, the PCD and gas mitigation assembly utilized by the linear pump may provide several other advantages as discussed herein. In the case that a permanent magnet motor is utilized, precise control and determination of position can be determined without the use of sensors disposed within the linear pump.

Further, in motors or pumps with lubricating oil provided in a sealed off chamber, pressure compensation may be important. If the motor or pump causes changes in pressure to the lubricating oil, it may cause lubricating oil to be forced out or may cause external fluids to be sucked in. The PCD discussed previously prevents or minimizes a pressure differential between lubricating oil and external fluids.

In traditional rod lift system or other reciprocating pump systems, the traveling valve is above the standing valve. As a result the traveling valve is traveling in the wrong direction to unseat the standing valve. In contrast, the traveling valve and standing valve arrangement discussed allows the standing valve to be easily and mechanically opened allowing gas to be produced.

In some embodiments, the linear pump is simplified to require no positioning sensors. The linear pump may rely on time and amp/power readings to determine position. This reduces the number of wires required going to the pump, which reduces complexity and cost. Surface controls may receive motor performance data. The data may be utilized to derive information about the well conditions, mechanical condition of the pump, formation fluid level, or the like.

Implementations described herein are included to demonstrate particular aspects of the present disclosure. It should be appreciated by those of skill in the art that the implementations described herein merely represent exemplary implementation of the disclosure. Those of ordinary skill in the art should, in light of the present disclosure, appreciate that many changes can be made in the specific implementations described and still obtain a like or similar result without departing from the spirit and scope of the present disclosure. From the foregoing description, one of ordinary skill in the art can easily ascertain the essential characteristics of this disclosure, and without departing from the spirit and scope thereof, can make various changes and modifications to adapt the disclosure to various usages and conditions. The implementations described hereinabove are meant to be illustrative only and should not be taken as limiting of the scope of the disclosure.

What is claimed is:

1. A linear pump for pumping production fluids from a well, the linear pump comprising:

an electric motor;

a rotary-to-linear mechanism coupled to the electric motor, wherein the rotary-to-linear mechanism converts rotary motion from the electric motor into linear motion in an upward direction or downward direction;

a lubrication region for the linear pump, wherein the lubrication region contains lubrication fluid for the linear pump that is isolated from the production fluids;

a pump plunger coupled to the rotary-to-linear mechanism, wherein the pump plunger moves in the upward or downward direction in accordance with the rotary-to-linear mechanism;

an intake coupled to the pump plunger for receiving the production fluids from the well;

a pump barrel receiving the production fluids, wherein the pump plunger reciprocates back and forth in the pump barrel to pump the production fluids;

a pressure compensation tubular disposed between the rotary-to-linear mechanism and the pump plunger;

a piston disposed within the pressure compensation tubular, wherein the piston separates the lubrication fluid from the production fluids, and the piston is movable within the pressure compensation tubular to compensate for a pressure differential between the lubrication fluid and the production fluids; and an encapsulator tubular with a first end coupled to the rotary-to-linear mechanism and a second end coupled to the pressure compensation tubular, wherein an internal region of the encapsulator tubular is in fluid communication with the lubrication region of the linear pump containing the lubrication fluid.

2. The linear pump of claim 1, wherein the rotary-to-linear mechanism comprises:

a ball screw coupled to the electric motor, wherein the ball screw is threaded with helical threads; and a ball nut threadably coupled to the ball screw, wherein rotating the ball screw in a first direction causes the ball nut to move linearly in an upward direction along the ball screw, and rotating the ball screw in a second direction, opposite to the first direction, causes the ball nut to move linearly in a downward direction along the ball screw.

3. The linear pump of claim 1, wherein the intake is a coupling nut connected to the pump plunger, the coupling nut providing one or more openings for receiving the production fluids.

4. The linear pump of claim 1, wherein the intake is a coupling nut connected to the pressure compensation tubular, and the coupling nut providing one or more openings that allow the production fluids to enter the pressure compensation tubular.

5. The linear pump of claim 1, further comprising a motor cap, wherein the motor cap provides a reservoir for the electric motor.

6. The linear pump of claim 1, wherein the pressure differential of 10 psi or less moves the piston in the pressure compensation tubular.

7. The linear pump of claim 1, further comprising:

a standing valve assembly coupled to production tubing above the pump plunger; and a travelling valve assembly coupled to a top portion of the pump plunger.

8. The linear pump of claim 7, wherein the standing valve assembly is a ball check valve, the travelling valve assembly provides a tip that extends into the standing valve assembly at a top of the linear pump upstroke, and the tip of the travelling valve unseats a ball of the ball check valve when the tip reaches the top of the linear pump upstroke.

9. The linear pump of claim 1, wherein a position of the pump plunger relative to the pump barrel is known during a pump stroke.

10. The linear pump of claim 1, further comprising a perforated sub allowing the production fluids from the well to enter the linear pump, wherein the pump plunger is disposed within the perforated sub.

11. A method for pumping production fluids from a well, the method comprising:

positioning linear pump in the well, the linear pump comprises an electric motor;

a rotary-to-linear mechanism coupled to the electric motor, wherein the rotary-to-linear mechanism converts rotary motion from the electric motor into linear motion in an upward direction or downward direction;

a lubrication region for the linear pump, wherein the lubrication region contains lubrication fluid for the linear pump that is isolated from the production fluids;

a pump plunger coupled to the rotary-to-linear mechanism, wherein the pump plunger moves in the upward or downward direction in accordance with the rotary-to-linear mechanism;

an intake coupled to the pump plunger for receiving the production fluids from the well;

a pump barrel receiving the production fluids from the pump plunger;

a pressure compensation tubular disposed between the rotary-to-linear mechanism and the pump plunger;

a piston disposed within the pressure compensation tubular, wherein the piston separates the lubrication fluid from the production fluids, and the piston is movable within the pressure compensation tubular to compensate for a pressure differential between the lubrication fluid and the production fluids; and an encapsulator tubular with a first end coupled to the rotary-to-linear mechanism and a second end coupled to the pressure compensation tubular, wherein an internal region of the encapsulator tubular is in fluid communication with the lubrication region of the linear pump containing the lubrication fluid; and operating the linear pump to reciprocate back and forth in the pump barrel to pump the production fluids.

12. The method of claim 11, wherein the linear pump further comprises:

a standing valve assembly coupled to production tubing above the pump plunger; and a travelling valve assembly coupled to a top portion of the pump plunger.

13. The method of claim 12, wherein the standing valve assembly is a ball check valve, the travelling valve assembly provides a tip that extends into the standing valve assembly at a top of the linear pump upstroke, and the linear pump is operated at a desired stroke length that causes the tip of the travelling valve assembly to unseat a ball of the standing valve assembly.

14. The method of claim 11, wherein the linear pump operates at speeds of 3000 rpm or below.

15. The method of claim 11, wherein the linear pump operates at production rates of 400 barrels per day or less.

16. The method of claim 11, wherein the rotary-to-linear mechanism comprises:

a ball screw coupled to the electric motor, wherein the ball screw is threaded with helical threads; and a ball nut threadably coupled to the ball screw, wherein rotating the ball screw in a first direction causes the ball nut to move linearly in an upward direction along the ball screw, and rotating the ball screw in a second direction, opposite to the first direction, causes the ball nut to move linearly in a downward direction along the ball screw.

17. The method of claim 11, wherein the intake is a coupling nut connected to the pressure compensation tubular, and the coupling nut providing one or more openings that allow the production fluids to enter the pressure compensation tubular.

* * * * *